US008720770B2

(12) United States Patent
Oppenheimer

(10) Patent No.: US 8,720,770 B2
(45) Date of Patent: May 13, 2014

(54) BOX PARTITION SET

(75) Inventor: Leonard Oppenheimer, Hewlett Harbor, NY (US)

(73) Assignee: The Golden Box, Inc., East Rockaway, NY (US)

( * ) Notice: Subject to any disclaimer, the term of this patent is extended or adjusted under 35 U.S.C. 154(b) by 400 days.

(21) Appl. No.: 13/037,821

(22) Filed: Mar. 1, 2011

(65) Prior Publication Data

US 2012/0223129 A1 Sep. 6, 2012

(51) Int. Cl.
*B65D 25/04* (2006.01)

(52) U.S. Cl.
USPC ..... 229/120.36; 229/117.16; 229/87.04

(58) Field of Classification Search
USPC ..... 229/117.16, 120.36, 87.04, 87.18, 229/120.24, 120.26, 120.29, 120.38
See application file for complete search history.

(56) References Cited

U.S. PATENT DOCUMENTS

| | | | | | |
|---|---|---|---|---|---|
| 2,284,385 | A | * | 5/1942 | Freshwaters | 229/117.16 |
| 2,611,527 | A | * | 9/1952 | Fisher | 229/117.18 |
| 3,425,544 | A | * | 2/1969 | Ayer et al. | 206/497 |
| 3,797,731 | A | * | 3/1974 | Weldon | 229/117.16 |
| 3,942,837 | A | * | 3/1976 | Engle | 229/120.36 |
| 3,994,432 | A | | 11/1976 | Kirby, Jr. | |
| 4,037,777 | A | | 7/1977 | Maughan | |
| 4,103,818 | A | | 8/1978 | Raubenheimer | |
| 4,408,710 | A | * | 10/1983 | Aust | 229/117.16 |
| 4,418,864 | A | | 12/1983 | Nielsen | |
| 4,492,332 | A | | 1/1985 | Collins | |
| 4,757,938 | A | | 7/1988 | Collins | |
| D298,413 | S | | 11/1988 | Raudat | |
| 4,793,548 | A | | 12/1988 | Ross | |
| 4,795,083 | A | | 1/1989 | Johnske | |
| 4,867,373 | A | | 9/1989 | Atkinson et al. | |
| 4,869,599 | A | * | 9/1989 | Allen | 383/38 |
| D339,745 | S | | 9/1993 | Duell | |
| 5,601,521 | A | | 2/1997 | Plamas Xapelli | |
| 5,626,284 | A | | 5/1997 | Franzen | |
| 5,682,984 | A | | 11/1997 | Hoell et al. | |
| 5,785,239 | A | | 7/1998 | Campbell et al. | |
| 6,112,977 | A | | 9/2000 | Sutherland et al. | |
| 6,896,175 | B2 | | 5/2005 | Duke et al. | |
| 6,968,992 | B2 | | 11/2005 | Schuster | |
| 7,134,551 | B2 | | 11/2006 | Harrelson | |
| D567,672 | S | | 4/2008 | Sheu | |
| D590,715 | S | | 4/2009 | Gilfert | |
| D613,164 | S | | 4/2010 | Lee | |
| 2004/0007612 | A1 | * | 1/2004 | Johanson et al. | 229/117.24 |
| 2006/0180788 | A1 | | 8/2006 | Scott et al. | |
| 2007/0007325 | A1 | | 1/2007 | Suzuki et al. | |
| 2007/0063003 | A1 | | 3/2007 | Spivey et al. | |
| 2007/0131748 | A1 | | 6/2007 | Brand | |
| 2008/0054055 | A1 | | 3/2008 | Holley | |
| 2008/0128479 | A1 | | 6/2008 | Bates et al. | |
| 2008/0223909 | A1 | * | 9/2008 | Gessler | 229/117.16 |
| 2009/0212095 | A1 | | 8/2009 | Auclair | |
| 2010/0044420 | A1 | | 2/2010 | Brand et al. | |
| 2010/0187295 | A1 | | 7/2010 | Spivey, Sr. et al. | |

* cited by examiner

*Primary Examiner* — Gary Elkins
*Assistant Examiner* — Phillip Schmidt
(74) *Attorney, Agent, or Firm* — Triangle Patents, PLLC

(57) ABSTRACT

A partition set for reinforcing a container's handles, the partition set including at least one interlocking subcomponent without hand holes and at least one interlocking subcomponent with two end panels with hand holes; the hand holes alignable with the container's hand holes; thereby providing reinforcement to the container's handles. Also, a container with hand hole reinforcement provided by the partition set.

16 Claims, 13 Drawing Sheets

BOX PARTITION SET

BACKGROUND OF THE INVENTION

1. Field of the Invention

The present invention relates to partitioning devices and, more specifically, to partitioning devices with hand holes for containers and carriers.

2. Description of the Prior Art

Prior art includes various inventions for the reinforcement of container handles. Container handles fail for a variety of reasons. In some cases, the contents are too heavy for the handles to support and they tear by compression and in-plane shearing, a condition termed "edge crush". In other similar cases, the user grips the handles and presses down on the top of the box with his palm, squeezes excessively, resulting again in edge crush. In yet other cases, the user bends the handles out-of-plane, which is a weaker position than in-plane, and the handles tear under much less force. Various prior art inventions have been designed to reinforce the handles and prevent failure.

U.S. Pat. No. 4,867,373 for a carton divider incorporating 3-ply lifting handle, describes a combined divider and handle reinforcing insert for a paperboard carton is formed with a three-ply thickness. It further describes first and second divider panels each having an upper edge and a lower edge and oppositely disposed first and second end edges, first and second handle panels each having upper and lower edges and oppositely disposed first and second end edges, the lower edges of the first and second handle panels being connected to the upper edge of the first and second divider panels respectively.

U.S. Pat. No. 5,785,239 for a reduced material carton divider and method of producing same teaches a carton divider having vertically oriented longitudinal partitions and vertically oriented transverse partitions inter-engaged to form a grid of cells for receiving glass containers. It further describes a reinforcing strip which extends laterally on opposite sides of a vertical line bisecting said cell wall face and extends vertically for a distance spanning the vertical extent of said cell wall face.

U.S. Pat. No. 6,112,977 for a bottle carrier with dividers describes a carrier comprising of a top panel section, a first side panel section and an opposing second side panel section, a bottom panel section, and a divider section. It further describes that the divider section includes a handle reinforcement portion, a first divider panel, and a second divider panel. The handle reinforcement portion is attached to a handle grip portion in the top panel.

SUMMARY OF THE INVENTION

The present invention relates to partition sets for containers and carriers.

It is an object of this invention to provide a partition set for a container that reinforces the handles of the container.

Yet another object of this invention is to provide a container with a partition set that reinforces the handles of the container.

A further object of this invention is to provide a shrink-wrapped container with a partition set that reinforces the handles in the shrink-wrap.

Accordingly, a broad embodiment of this invention is directed to a container with a partition, the partition ends providing reinforcement to the container handles.

These and other aspects of the present invention will become apparent to those skilled in the art after a reading of the following description of the preferred embodiment when considered with the drawings, as they support the claimed invention.

DETAILED DESCRIPTION

Figure 1:
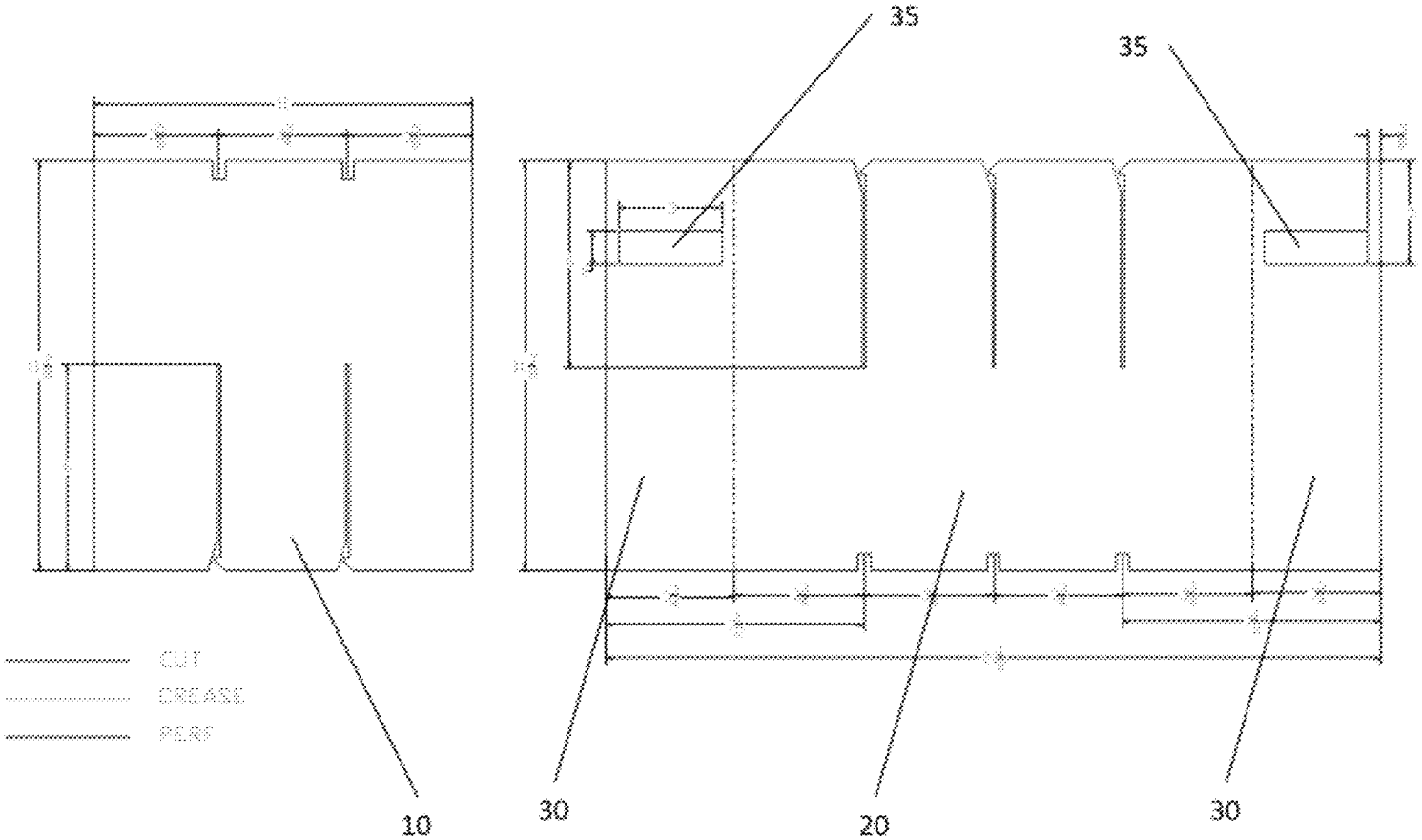
FIG. 1 is a schematic diagram of one embodiment of the invention, showing the partition subcomponents.

Referring now to the drawings in general, the illustrations are for the purpose of describing a preferred embodiment of the invention and are not intended to limit the invention thereto.

The present invention provides a partition set for a container. The partition set is composed of subcomponents, shown in FIG. 1. The partition set includes at least one interlocking subcomponent without a handle 10 and at least one interlocking subcomponent 20 with at least one end panel 30, the end panel having at least one hand hole 35.

Figure 2:
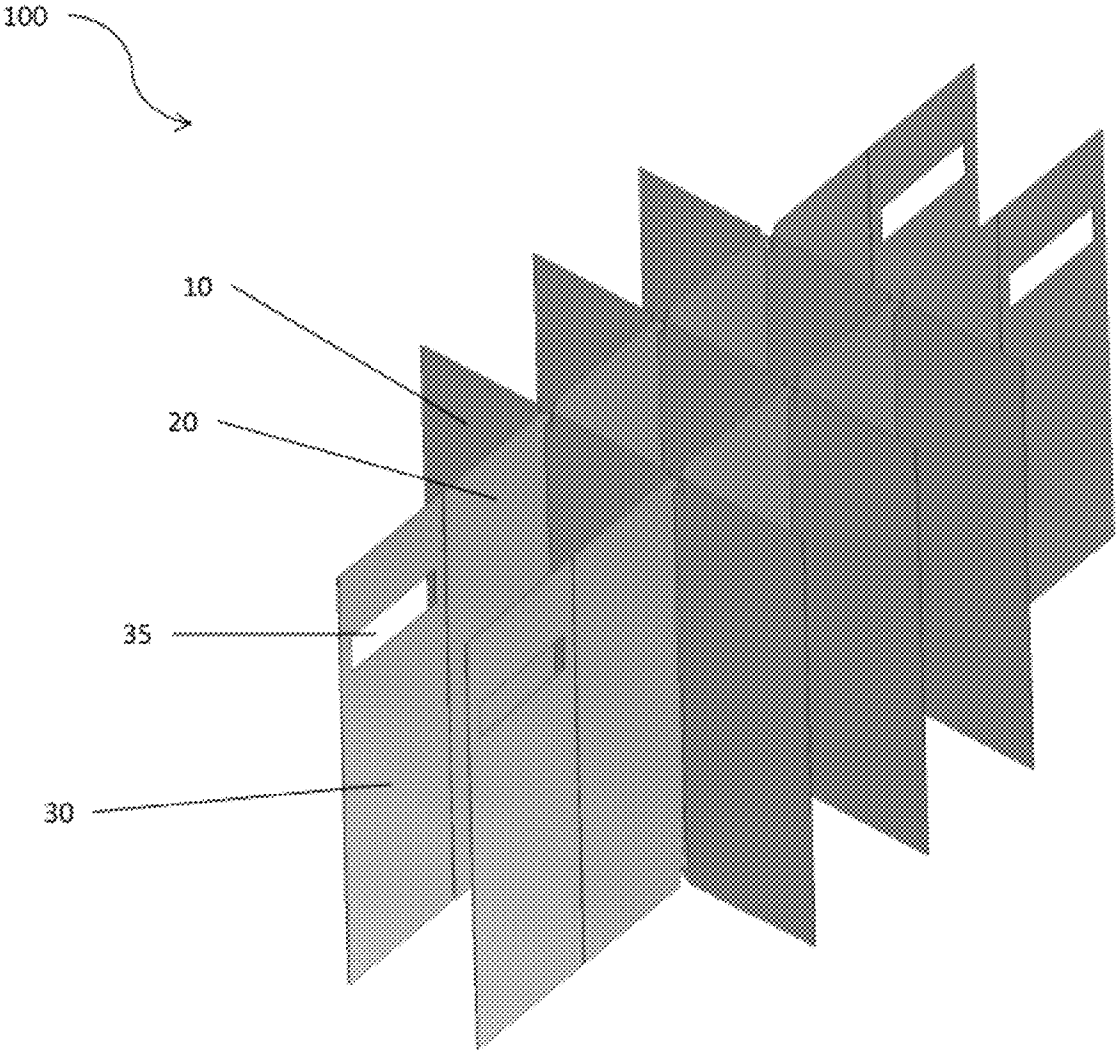
FIG. 2 is a schematic diagram of one embodiment of the invention, showing the partition subcomponents assembled with the end panels unfolded.
Figure 3:
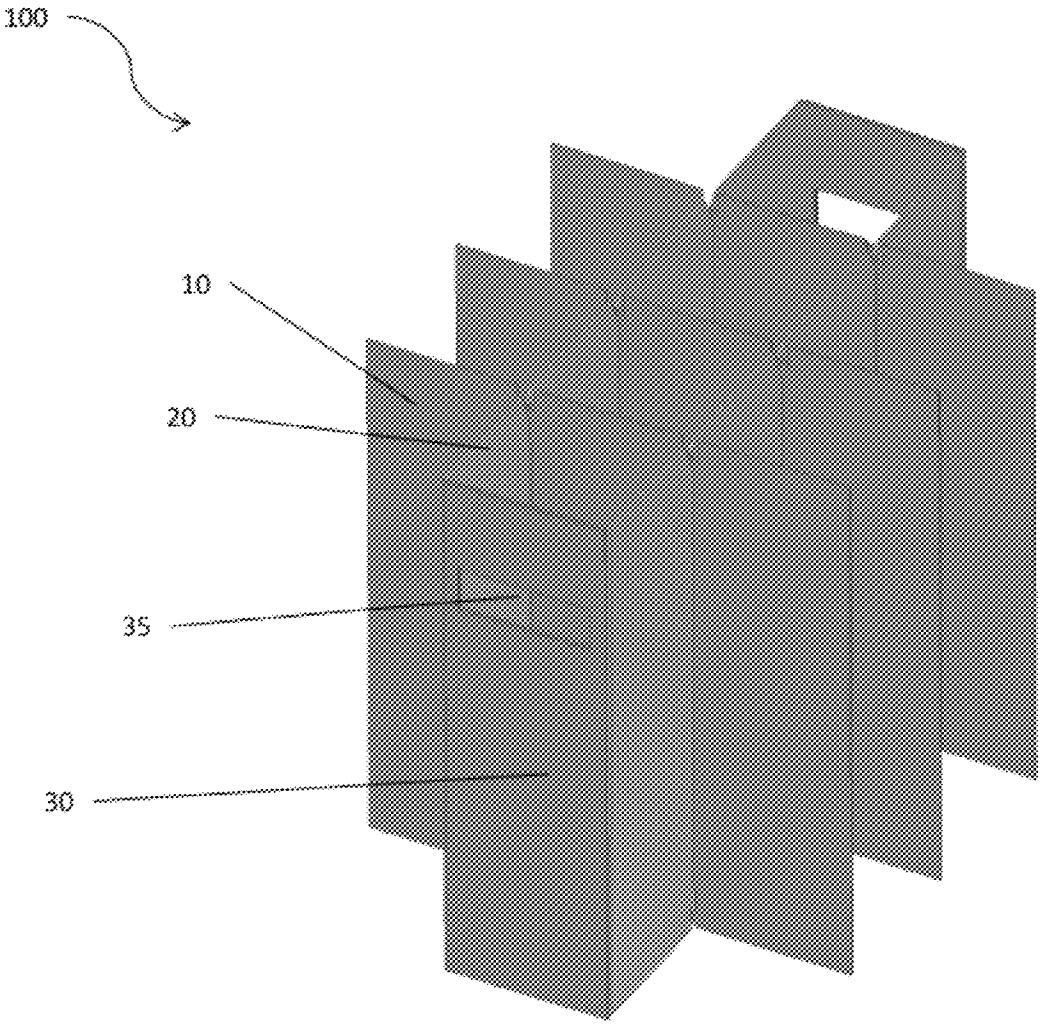
FIG. 3 is a schematic diagram of one embodiment of the invention, showing the partition subcomponents assembled with the end panels folded.

The subcomponents are assembled into a partition, generally shown as 100 in FIGS. 2 and 3. Once assembled, the end panels 30 of the subcomponents are folded prior to placement in the container, as shown in FIG. 3. Once folded, the partition set is placed in the container 45, as shown in an example embodiment in FIG. 4.

Figure 4:
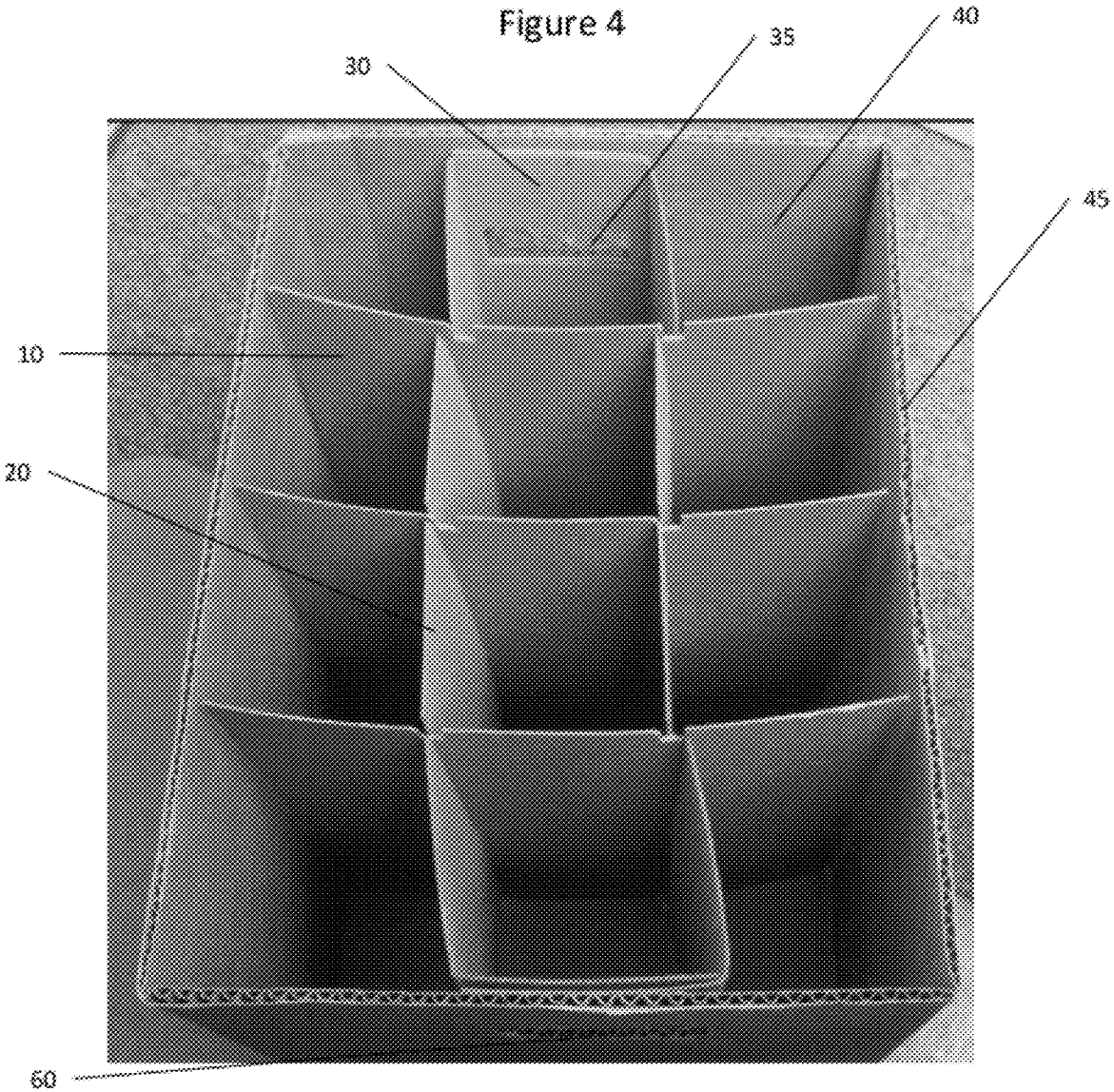
FIG. 4 is a schematic diagram of one embodiment of the invention, showing the partition and container assembled.

The partition set separates the container contents and provides reinforcement for the hand holes in the container. The partition end panels 30 fold to abut against the handle sides 40 of a container 45. The end panel hand holes 35 match and align with the hand holes 60 in the sides of container when the end panels are folded and abutted against the sides of the container, as shown in FIG. 4. This positioning provides reinforcement to the container hand holes 60 in several ways. One method of reinforcement is by preventing the container sides above the hand hole from tearing out-of-plane when the user lifts the container. This method of tearing, out-of-plane tearing, requires less force than the method wherein the container side compresses upward, compression tearing. Therefore, adding reinforcement to prevent this method of tearing is useful for containers in which the content weight does not exceed the compression tearing limit but does exceed the out-of-plane tearing limit. Another method of handle failure is edge crush by the bearer. In edge crush, the bearer grips the handles and presses down on the top of the box with his palm, squeezing excessively, and crushing the handle. The present invention provides resistance against this type of crushing because it provides additional support between the handle and the top of the container.

In cases where the container includes a top, the partition set is designed and configured to abut against the top when the container is closed (not shown). In this manner, the partition set also provides support against compression tearing. That is, the partition set abuts against the top and now provides a downward resisting force against the upward compression force, in addition to the resistance provided against the out-of-plane force. In these cases, the partitions with the end panels 20 are slotted to fit into the cross panels 10 from below, as shown in the figures. This configuration helps distribute the compression force over all the subcomponents contacting the top of the container.

The end panels, which provide the majority of the tearing and crushing resistance of the partition set according to the present invention, can be reinforced to provide even further support. For example, varnish, paint, tape, glue and the like and combinations thereof can be added around the hand holes on the end panel. Additionally or alternatively, low adhesive glue, such as low-tack, pressure-sensitive glue, such as that used in Post-It notes, can be applied to the outside surface of the end panels. When the container handles are gripped, the increased pressure causes the glued panels to adhere to the container and prevent slipping. The low-tackiness of the glue allows the subcomponents to be stacked, yet easily separable.

Figure 5:
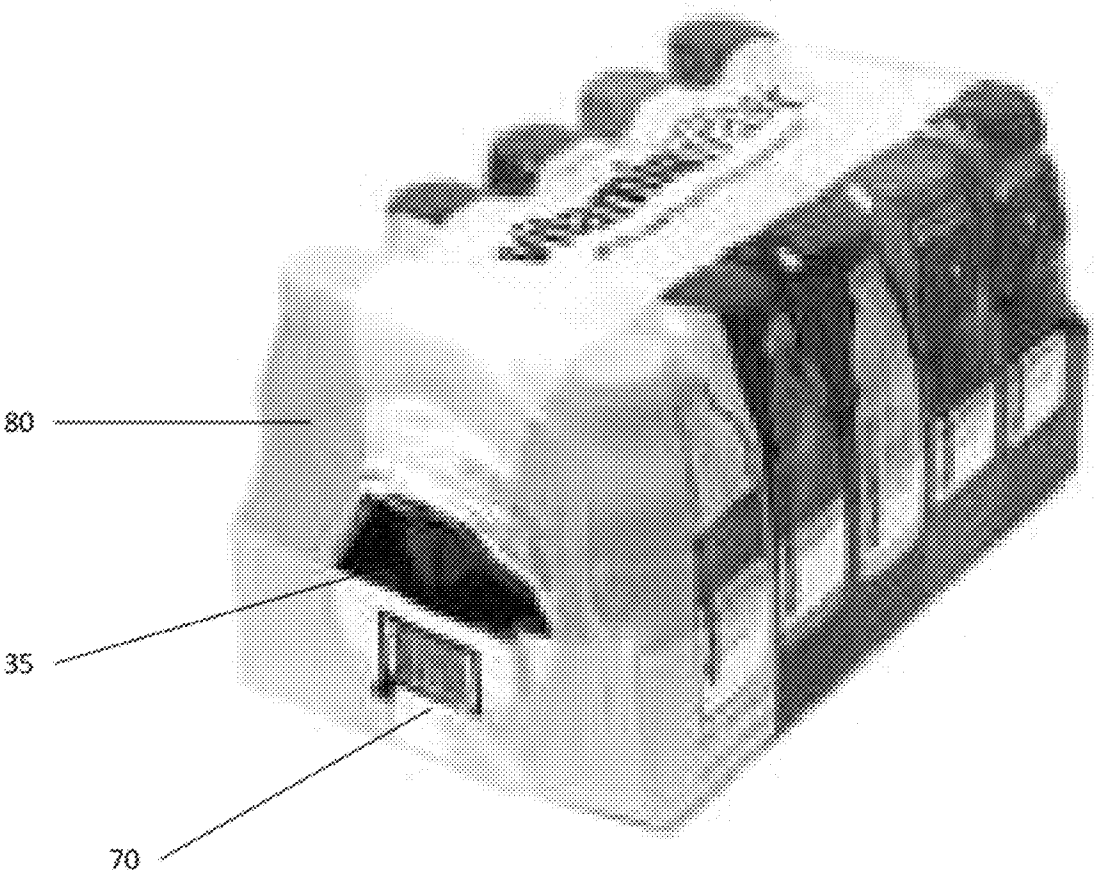
FIG. 5 is a drawing of one embodiment of the invention, showing the partition used in a plastic-wrapped container.

The present invention can be used in a variety of containers where the handles are subject to failure. For example, as shown in FIG. 5, the present invention can be used in a container wherein the container is formed from a base 70 and a plastic wrap 80, such as shrink wrap. In this example embodiment, the base does not include hand holes; the hand holes are included in the shrink-wrap 80 and the partition hand holes align with and abut these. The partition end panel thus provides reinforcement to the shrink-wrap around the hand holes.

The present invention also provides additional support when the containers are stacked. The hand holes greatly reduce the compression support of the end panel directly beneath and above them, sometimes resulting in crushing of the area above the hand hole. The present invention provides additional support to prevent this crushing.

Figure 6:
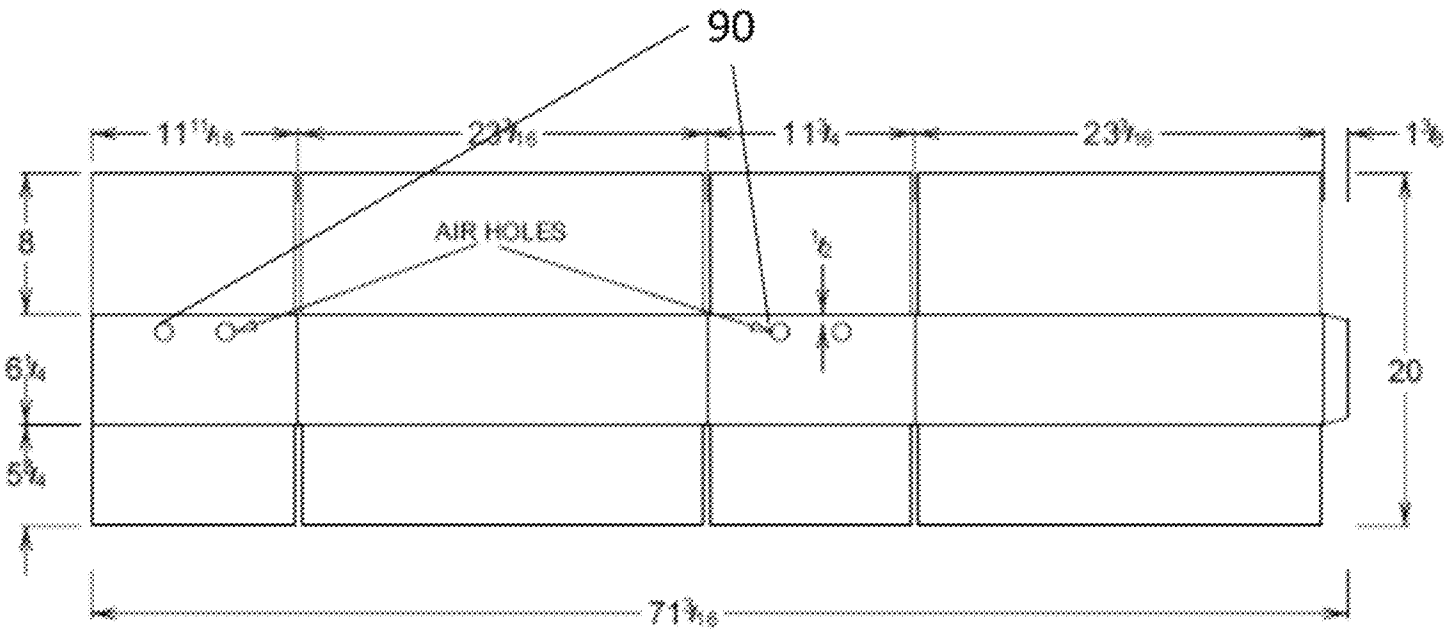
FIG. 6 is a schematic drawing of one embodiment of the invention, showing the partition with finger holes.
Figure 7:
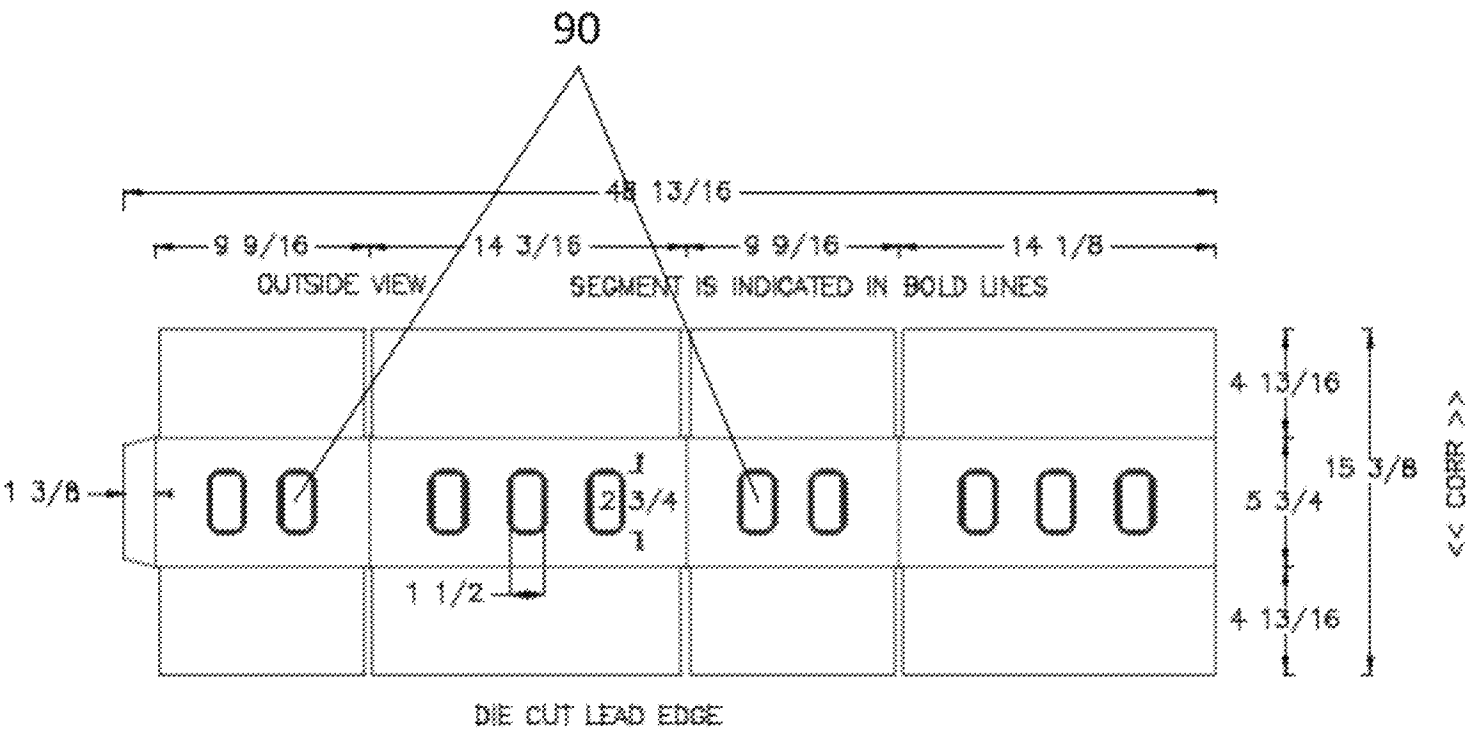
FIG. 7 is a schematic drawing of the invention, showing another embodiment with finger holes.
Figure 13:
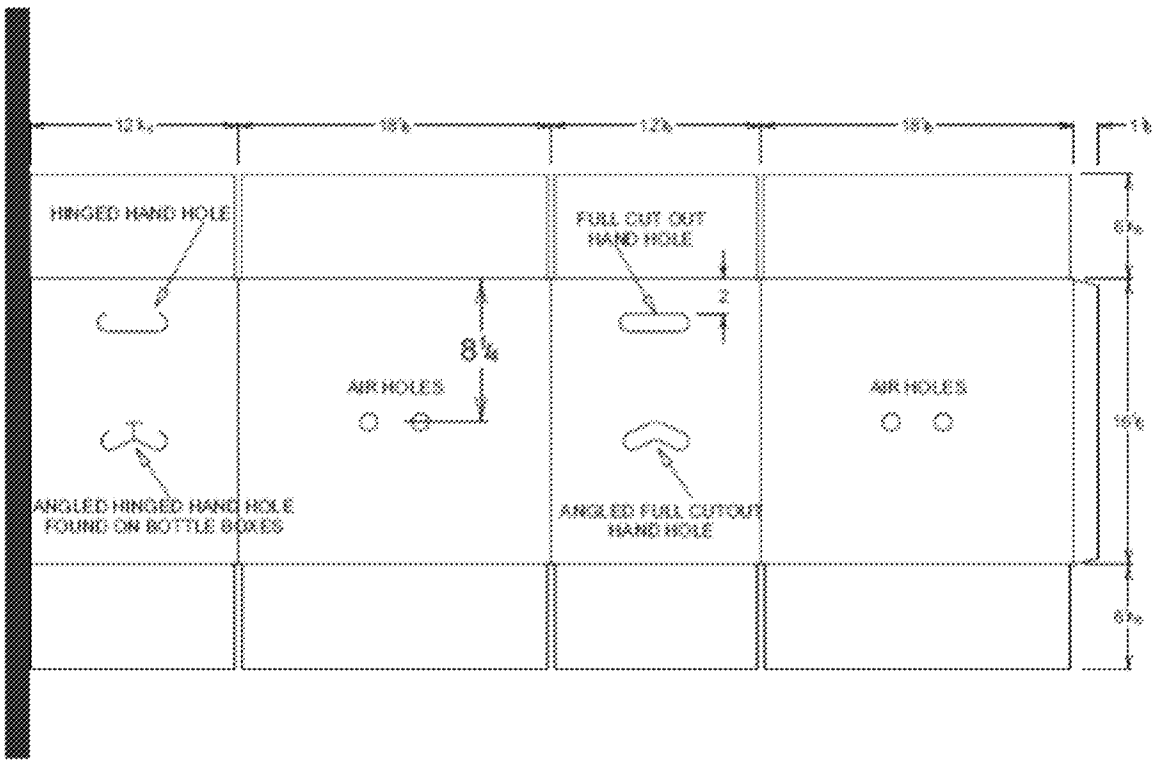
FIG. 13 is a drawing example of different hand hole configurations.

The present invention is designed and configured to provide support for standard hand holes for cardboard box containers and also for containers and end panels with diverse sizes and configurations. For example, the hand holes can be a multiplicity of finger holes 90, as shown in FIGS. 6 and 7. Multiple finger holes are advantageous over a single hand hole because they increase the amount of both lateral and vertical support for each horizontal length of handle, and thus increase the strength of the handle system. FIG. 13 shows other configurations for hand holes, including angled holes.

Figure 8:
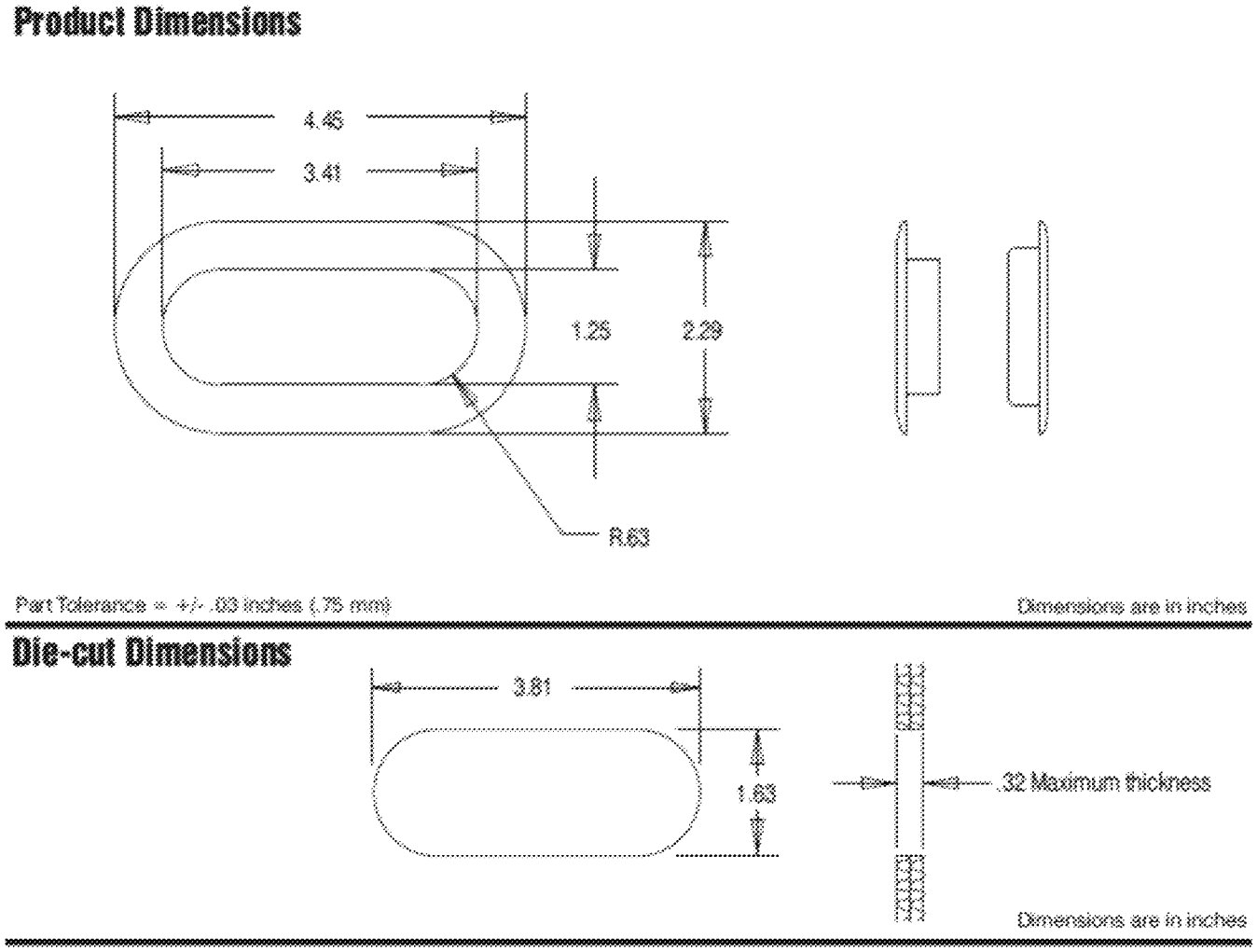
FIG. 8 is a drawing of one embodiment of the invention, showing a reinforcing attachment for the hand hole.
Figure 9:
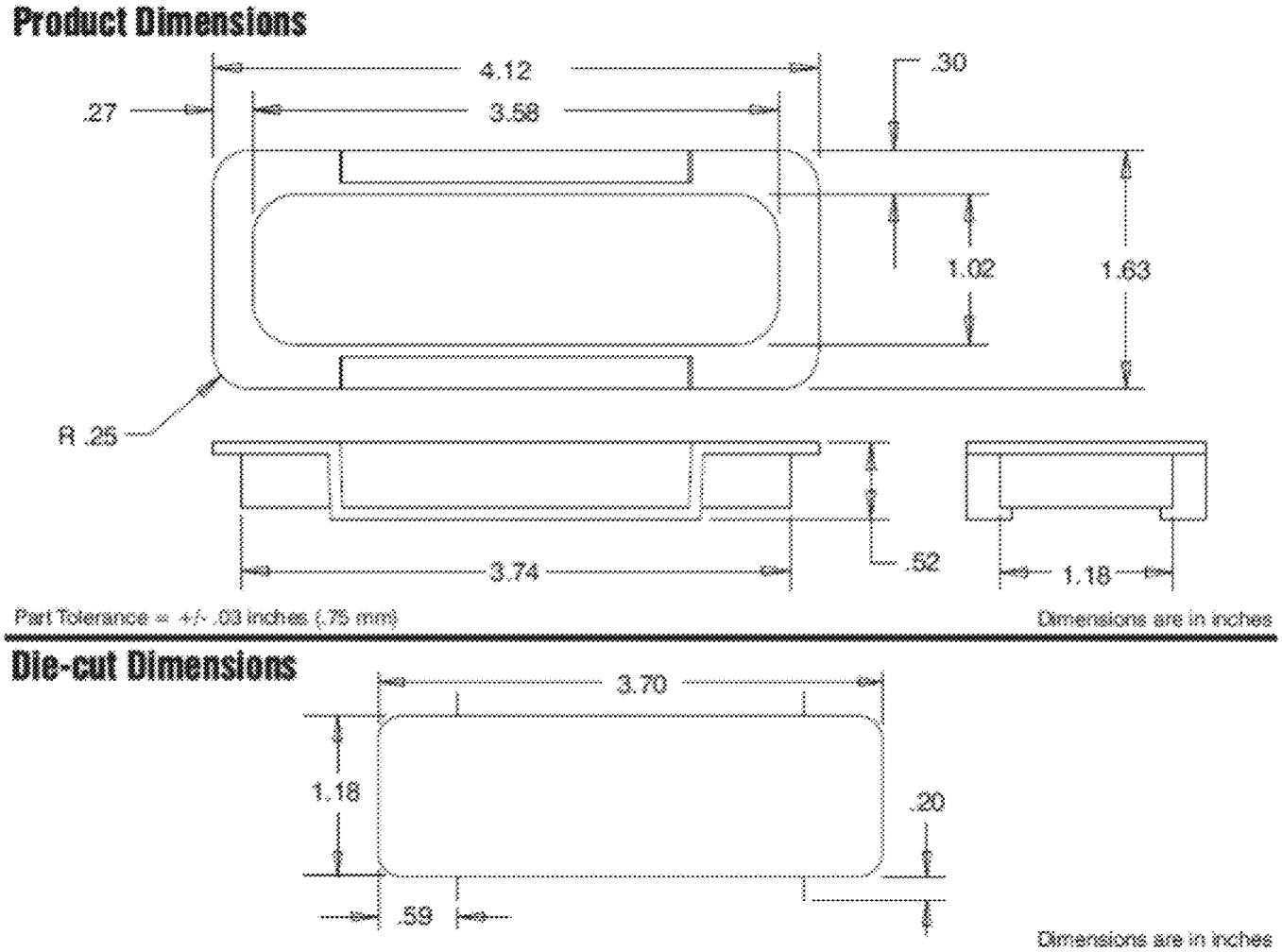
FIG. 9 is a drawing of one embodiment of the invention, showing another reinforcing attachment for the hand hole.

Certain task may require additional reinforcement. In those cases, the present invention provides several embodiments. FIGS. 8 and 9 show reinforcing attachments for the hand holes. These reinforcing attachments can be two-piece design, as shown in FIG. 8, or one-piece design, as shown in FIG. 9. These are preferably made of plastic and are designed and configured to snap into place, locking the end panel to the container side and providing additional support.

Figure 10:
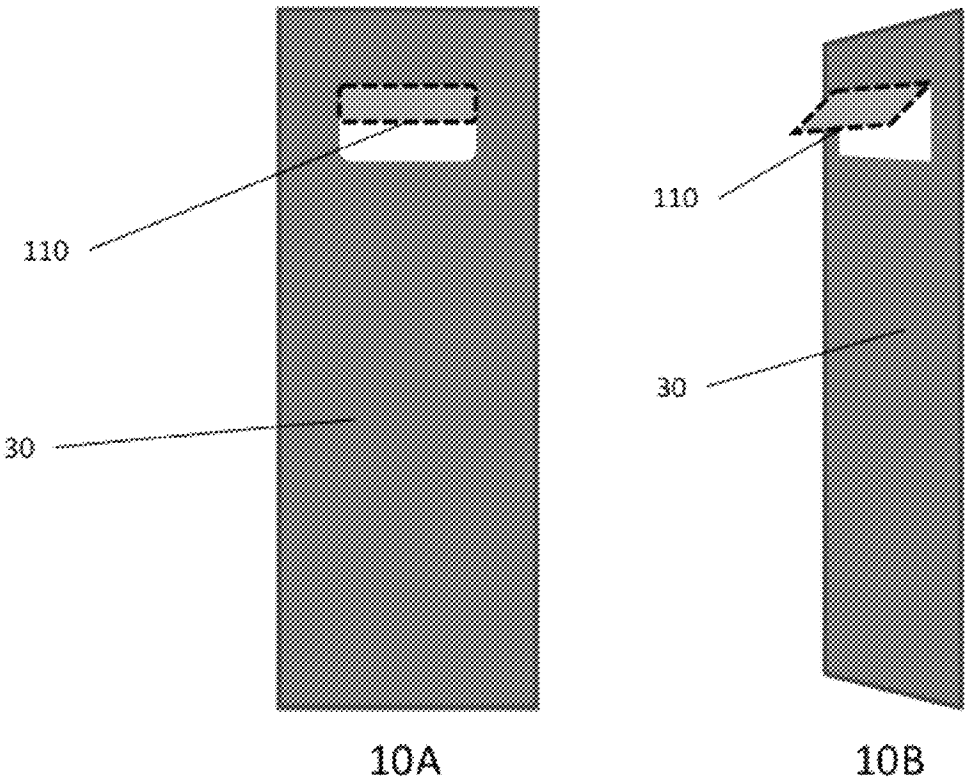
FIGS. 10A and B are drawings of another embodiment of the invention, showing a comfort flap in an end panel.

Another embodiment that provides user comfort and additional reinforcement is shown in FIGS. 10A and B. In this embodiment the hand hole is only partially cut out of the end panel, leaving a flap 110. The upper part of the hand hole cut-out is left attached to the panel such that it can hinge outwards, thus forming a comfort flap. The flap need not be excessive; merely long enough to extend across the top of the container's hand hole when folded outward by the user. The flat surface of the flap provides comfort to the user because it prevents the user from contacting the sharper edges of the container hand holes.

Figure 11:
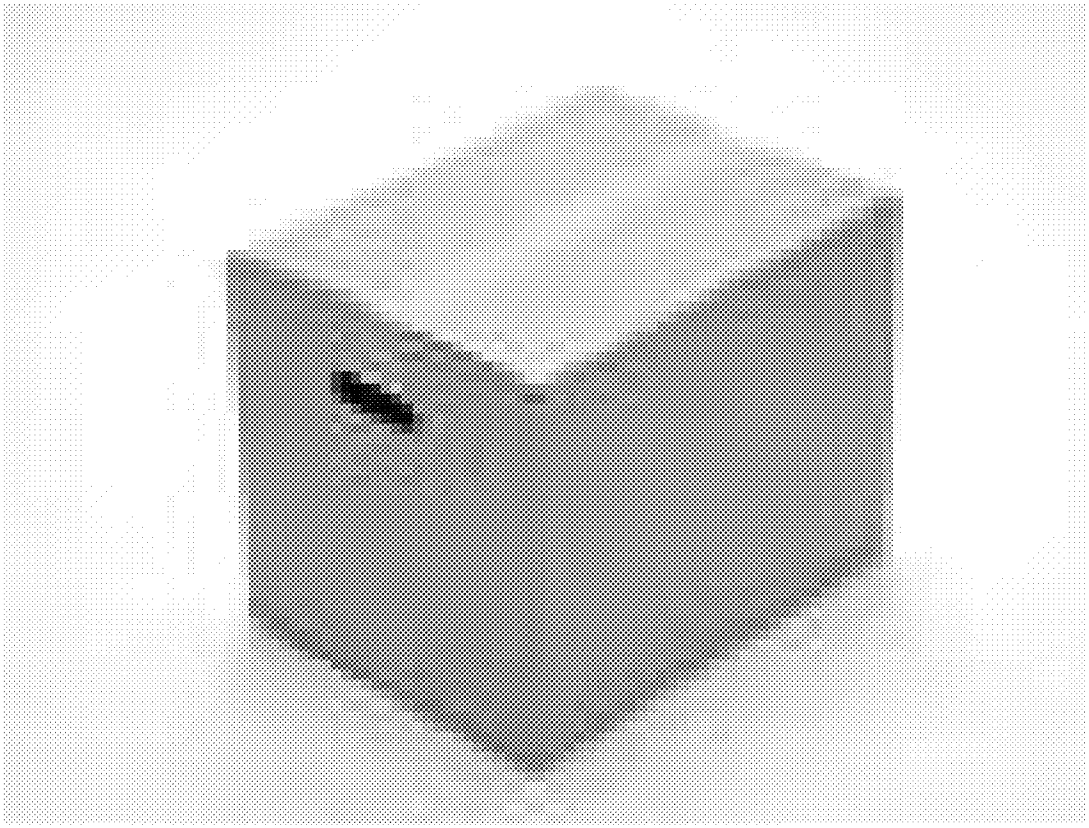
FIG. 11 is a drawing of an example embodiment of the invention.
Figure 12:
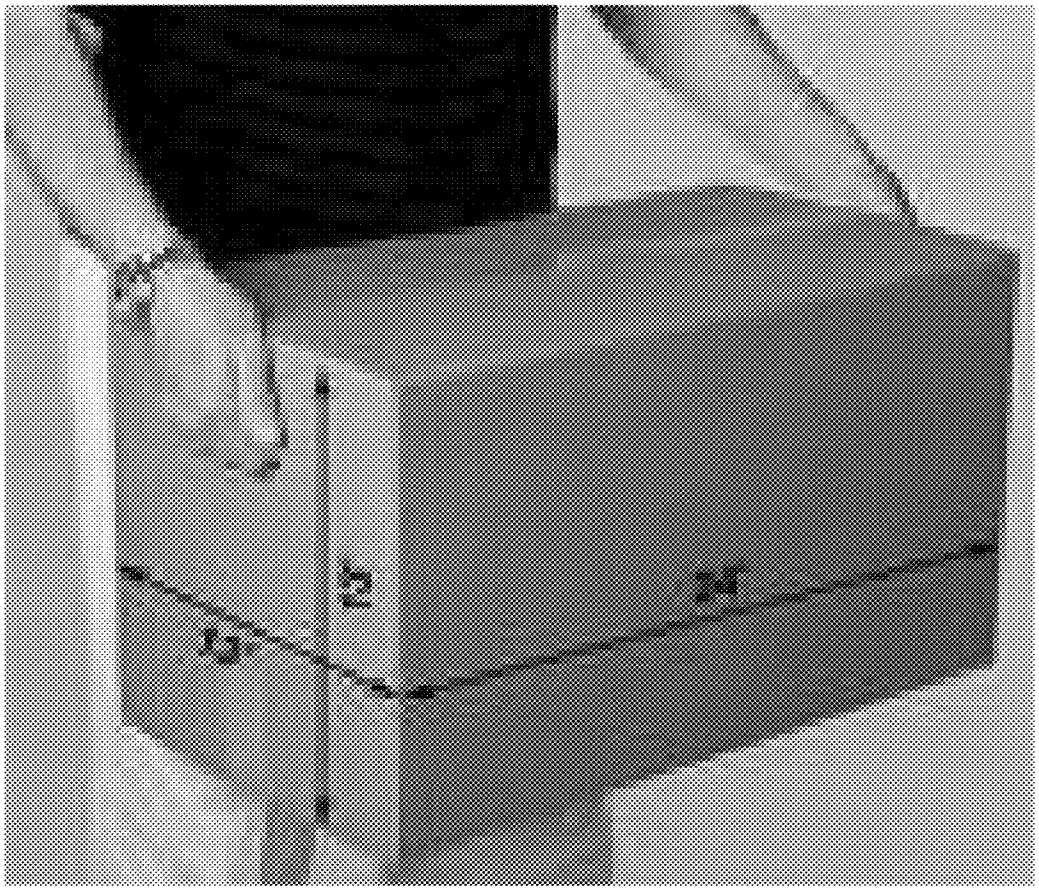
FIG. 12 is a drawing of an example embodiment of the invention.

FIGS. 11 through 12 show example embodiments of the present invention. FIG. 11 shows a carrier closed with partition inside (not visible), wherein the carrier a closed rectangular box shape. FIG. 12 shows a similar embodiment to FIG. 11 being lifted by a user.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

What is claimed is:

1. A partition set for reinforcing a container's handles, the partition set comprising: at least one interlocking subcomponent without hand holes and a plurality of interlocking subcomponents with two end panels, one on each end, with hand holes, wherein the interlocking subcomponents are provided as a partition and for bearing a vertical load, the interlocking subcomponents constructed and configured to interlock with one another orthogonally; the hand holes alignable with the container's handles, the interlocking subcomponents having an equal height and constructed and configured to abut the top of the container when the top is closed to provide distribution of the vertical load over the partition subcomponents; wherein two of the interlocking subcomponents with the hand holes and the end panels on each end are assembled parallel to each other so that an end panel from each of the interlocking subcomponents are grouped to form a pair of proximal end panels, the proximal end panels constructed and configured to contact one another and further including a covering of a low-tack, pressure-sensitive glue coating on the end panels for adhering to one another and a side of the container for reinforcement; thereby providing reinforcement to the container's handles and reduced load when the container top is closed.

2. The partition set of claim 1, wherein the hand holes are single-finger holes.

3. The partition set of claim 1, further including reinforcement attachments, the reinforcement attachments aligning and holding together the hand holes of the end panels and the container.

4. The partition set of claim 1, further including additional reinforcement selected from the group consisting of varnish, paint, tape, glue and combinations thereof.

5. The partition set of claim 1, wherein the container is a plastic wrap.

6. A container with hand hole reinforcement, comprising: a container with a content, a bottom, a top, sides and hand holes; at least one interlocking partition subcomponent without hand holes and a plurality of interlocking subcomponents with two end panels with hand holes, the subcomponents constructed and configured to interlock with one another orthogonally; the interlocking subcomponents interlocked and inserted in the container; the interlocking subcomponents having an equal height and constructed and configured to abut the top of the container when the top is closed; the end panels folded to align the hand holes with the container's hand holes; wherein two of the interlocking subcomponents with hand holes and end panels are constructed and configured to contact one another and further including a covering of a low-tack, pressure-sensitive glue coating on the end panels for adhering to one another and a side of the container for reinforcement; thereby providing a container with reinforced hand holes.

7. The container of claim 6, wherein the hand holes are single finger holes.

8. The container of claim 6, further including reinforcement attachments, the reinforcement attachments aligning and holding together the hand holes of the end panels and the container.

9. The container of claim 6, further including additional reinforcement selected from the group consisting of varnish, paint, tape, glue and combinations thereof.

10. The container of claim 6, wherein the container is a plastic wrap.

11. The container of claim 6, further including a bottom.

12. A container with hand hole reinforcement, comprising: at least one interlocking partition subcomponent without hand holes and at least two interlocking partition subcomponents with two end panels with hand holes folded to fit in the container; the interlocking subcomponents interlocked and inserted in the container; a plastic wrapping encompassing the container with partition; the plastic wrapping including hand holes; the hand holes in the partition aligning and abutting with the hand holes in the plastic wrap; all subcomponents abutting against the top plastic wrapping to provide a resisting force against the vertical force of lifting; wherein two of the interlocking subcomponents with hand holes and end panels on each end are assembled parallel to each other so that an end panel from each of the interlocking subcomponents are grouped to form a pair of proximal end panels, the proximal end panels constructed and configured to contact one another and further including a covering of a low-tack, pressure-sensitive glue coating on the end panels for adhering to one another and a side of the container for reinforcement; thereby providing a container with reinforced hand holes.

13. The container of claim 12, wherein the hand holes are single finger holes.

14. The container of claim 12, further including reinforcement attachments, the reinforcement attachments aligning and holding together the hand holes of the end panels and the container.

15. The container of claim 12, further including additional reinforcement selected from the group consisting of varnish, paint, tape, glue and combinations thereof.

16. The container of claim 12, further including a low-tack, pressure-sensitive glue coating on the end panels for reinforcement.

* * * * *